US006349619B1

(12) United States Patent
Liao

(10) Patent No.: US 6,349,619 B1
(45) Date of Patent: Feb. 26, 2002

(54) RATCHET DRIVING TOOL

(76) Inventor: Yung Chung Liao, No. 68-1, Fu Hsin North Road, Taichung (TW), 407

( * ) Notice: Subject to any disclaimer, the term of this patent is extended or adjusted under 35 U.S.C. 154(b) by 0 days.

(21) Appl. No.: 09/659,053

(22) Filed: Sep. 11, 2000

(51) Int. Cl.[7] ..... B25B 13/46
(52) U.S. Cl. ..... 81/62; 81/177.9
(58) Field of Search ..... 81/61–63.2, 177.7–177.9; 192/43.1

(56) References Cited

U.S. PATENT DOCUMENTS 1,995,009 A * 3/1935 Pfauser et al. ..... 81/63.2
2,013,765 A * 9/1935 Richardson ..... 81/61
2,407,558 A * 9/1946 Kress ..... 81/62
2,732,049 A * 1/1956 Deliso ..... 81/62
5,573,093 A 11/1996 Lee ..... 192/43.2
5,737,982 A * 4/1998 Lin ..... 81/63.1
6,000,302 A 12/1999 Chiang ..... 81/177.8
6,047,802 A 4/2000 Huang ..... 192/43.2

* cited by examiner

*Primary Examiner*—D. S. Meislin
(74) *Attorney, Agent, or Firm*—Charles E. Baxley

(57) ABSTRACT

A ratchet tool includes a housing having an internal gear, a shank rotatably secured in the chamber of the housing and having two notches formed between a partition and two actuating surfaces for rotatably receiving two pawls, and a spring engaged between the pawls for biasing the pawls to engage with the internal gear. A control ferrule is rotatably engaged on the shank and includes two blocks for selectively disengaging the pawls from the internal gear. The actuating surfaces of the shank may be used for solidly engaging the pawls with the internal gear.

12 Claims, 7 Drawing Sheets

RATCHET DRIVING TOOL

BACKGROUND OF THE INVENTION

1. Field of the Invention

The present invention relates to a tool. and more particularly to a ratchet driving tool.

2. Description of the Prior Art

U.S. Pat. No. 5,573,093 to Lee and U.S. Pat. No. 6,047,802 to Huang disclose two typical ratchet tools having a pair of pawls biased to engage with a gear or an internal gear, in order to control the driving direction of the ratchet tools. These kinds of ratchet tools may not sustain or may not be subjected with a great driving or rotational torque or force.

U.S. Pat. No. 6,000,302 to Chiang discloses a typical tool having a rotational driving head and having a button for indirectly controlling the rotational operation of the driving head via a pawl. The button may not be provided with a spring for biasing against the driving head or against the pawl.

The present invention has arisen to mitigate and/or obviate the afore-described disadvantages of the conventional ratchet tools.

SUMMARY OF THE INVENTION

The primary objective of the present invention is to provide a ratchet tool including a ratchet device for resisting a great rotational driving force or a driving torque and including a driving head that may be biased and positioned to the handle with a spring biased mechanism provided in a control button.

In accordance with one aspect of the invention, there is provided a ratchet tool comprising a housing including a chamber formed therein and including an internal gear provided therein, a shank rotatably secured to the housing and received in the chamber of the housing, the shank including a pair of notches formed therein and including a partition formed between the notches thereof, and including a pair of actuating surfaces, the notches of the shank being defined between the partition and the actuating surfaces respectively, a first pawl and a second pawl rotatably received in the notches of the shank respectively and engageable with the actuating surfaces of the shank, for engaging with the internal gear and for controlling a driving direction of the housing relative to the shank, means for biasing the first pawl and the second pawl to engage with the internal gear, and means for selectively disengaging the first pawl and the second pawl from the internal gear. The actuating surfaces of the shank is engaged with the pawls for solidly engaging the pawls with the internal gear.

The housing includes a driving stem and a screw hole, the shank includes a bore and a peripheral shoulder, a fastener is engaged in the bore of the shank and has a head engaged with the shoulder of the shank and threaded with the screw hole of the housing for rotatably securing the shank to the housing.

The shank includes a pair of bulges extended inward of the notches of the shank, the first and the second pawls each includes a cavity formed therein for receiving the bulges of the shank and for rotatably securing the first and the second pawls to the shank.

The partition of the shank includes an aperture formed therein, the biasing means includes a spring engaged in the aperture of the partition and engaged with the first and the second pawls.

The selectively disengaging means includes a control ferrule rotatably engaged on the shank and having two blocks engaged with the pawls respectively for disengaging the first and the second pawls from the internal gear when the control ferrule is rotated relative to the shank. A device is further provided for positioning the control ferrule to the shank at a selected angular position.

The control ferrule includes an annular flanges the shank includes a shoulder engaged with the annular flange of the control ferrule, the ratchet tool further includes a sleeve engaged on the shank and engaged with the annular flange of the control ferrule for positioning the control ferrule to the shank.

A seat includes a peripheral portion having a plurality of depression, the shank has an extension rotatably secured to the seat with a shaft, the shank includes a bore for receiving a ball, and means for actuating the ball to engage with either of the depressions of the seat and to position the shank to the seat at any selected angular position.

The shank includes a hole, the actuating means includes a button slidably received in the hole of the shank and having an opening for receiving the ball and for allowing the ball to be disengaged from the seat, the button includes an actuator extended inward of the opening thereof for engaging with the ball and for forcing the ball to engage with either of the depressions of the seat, and a first biasing means for biasing the actuator of the button to engage with the ball and to force the ball to engage with the seat.

A second biasing device may bias the ball to engage with the seat and includes a spring member secured to the button and engaged with the ball. The button includes a cavity formed therein, the spring member includes a leg engaged into the cavity of the button for securing the spring member to the button.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
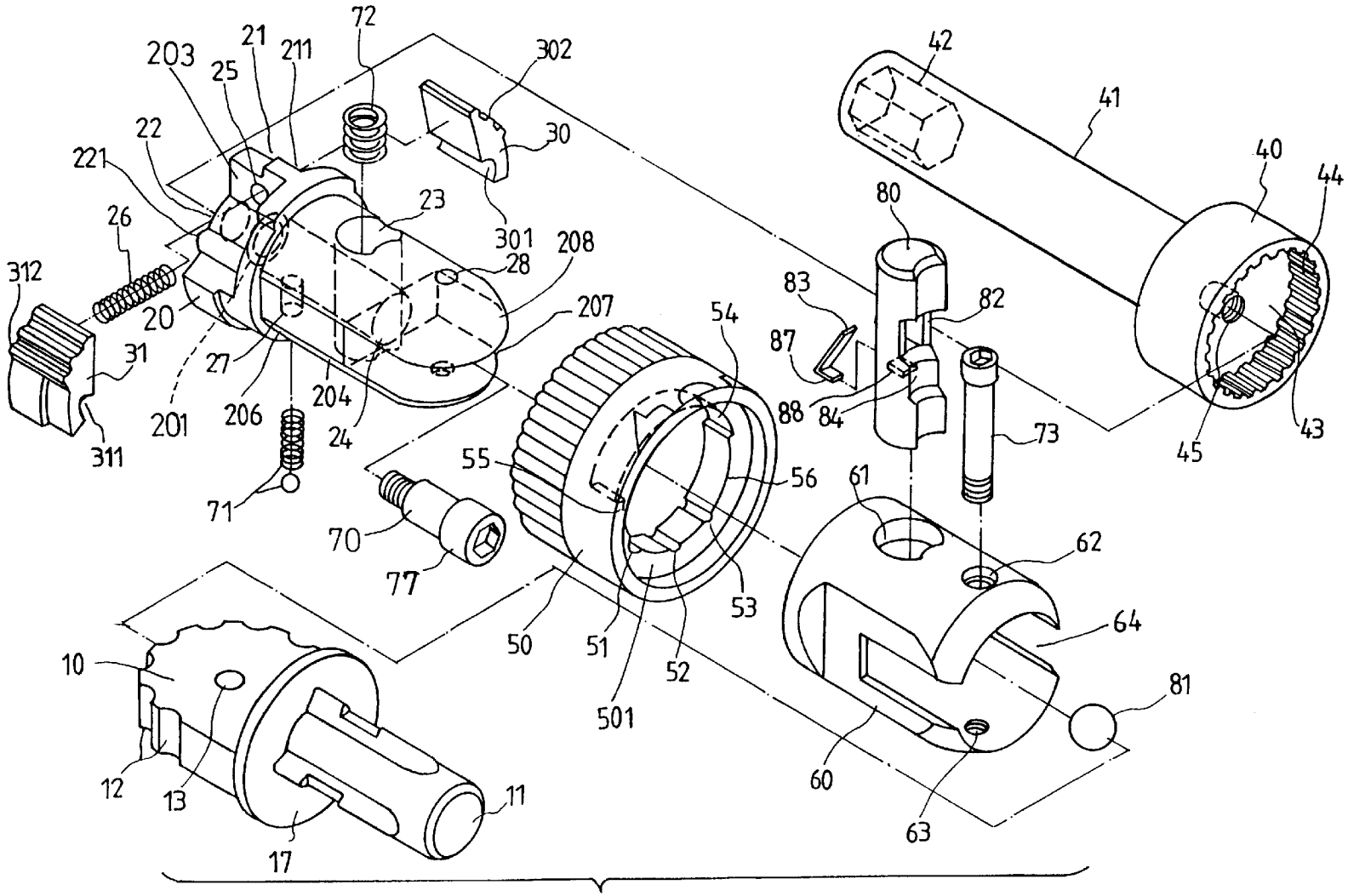
FIG. 1 is an exploded view of a ratchet tool in accordance with the present invention.

Referring to the drawings, and initially to FIGS. 1–4, a ratchet tool in accordance with the present invention comprises a seat 10 including a stud 11 extended therefrom and engaged in a cavity 16 of a tool handle 14 and including a stop flange 17 provided in the middle portion thereof for engaging with the tool handle 14 and for limiting the engagement of the stud 11 into the tool handle 14. The seat 10 includes a substantially circular outer peripheral surface having a number of depressions 12 formed therein for positioning purposes, and includes a hole 13 formed therein for receiving a shaft 73.

A driving stem 41 includes a tool device 42, such as an engaging hole 42, formed or provided in one end thereof for engaging with and for driving the fasteners or the tool extensions or the tool bits etc. The tool device may also be a tool extension provided or extended from the driving stem 41 for directly engaging with and for driving the fasteners, for example. The driving stem 41 includes a housing 40 formed or provided on one end thereof and having a chamber 43 and an internal gear 44 formed or provided therein, and having a screw hole 45 formed therein and communicating with the chamber 43 thereof.

Figure 5:
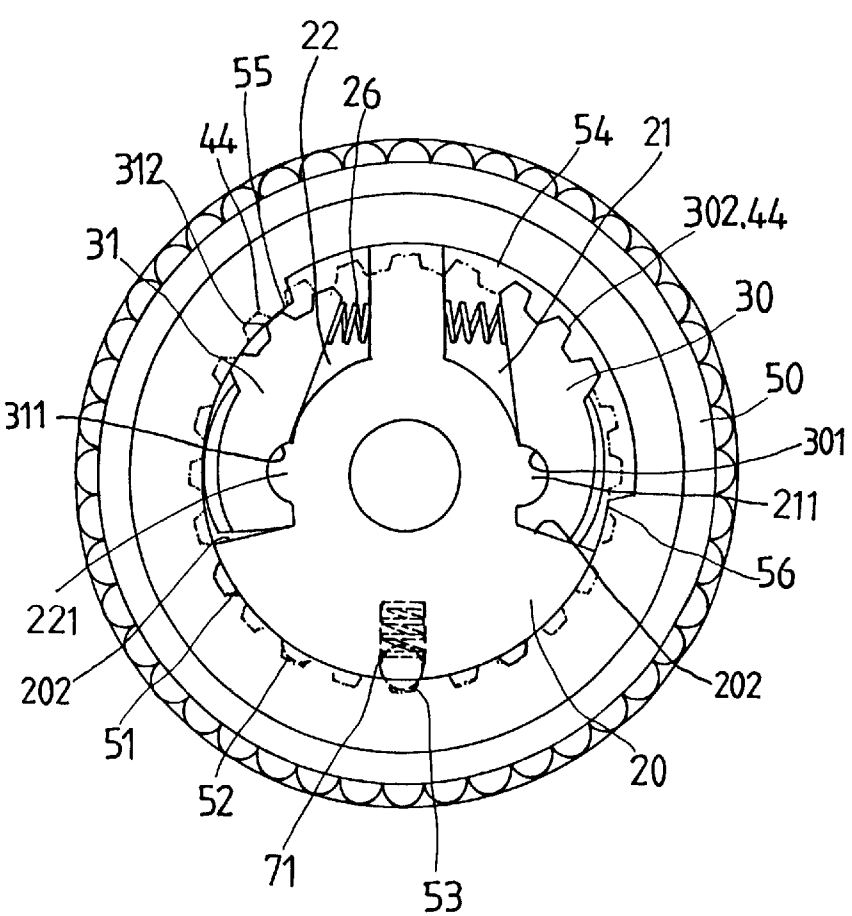
FIG. 5 is a partial cross sectional view similar to FIG. 4, illustrating the operation of the ratchet tool.
Figure 4:
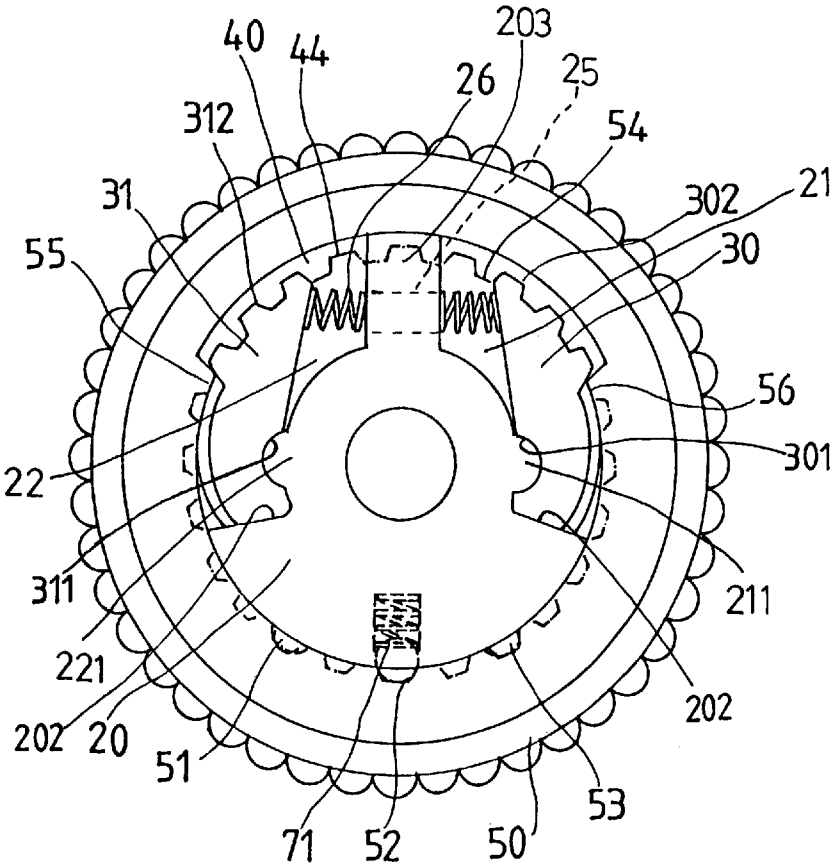
FIG. 4 is a partial cross sectional view taken along lines 4—4 of FIG. 2.

A shank 20 includes a bore 24 formed therein for receiving a fastener 70, and includes a shoulder. such as a peripheral shoulder 201 formed in the bore 24 thereof for engaging with the head 77 of the fastener 70 which is threaded with the screw hole 45 of the housing 40 and which is provided for rotatably securing the shank 20 to the housing 40 of the driving stem 41. The shank 20 includes a pair of notches 21, 22 formed therein and a pair of semi-spherical or semi-circular bulges 211, 221 extended inward of the notches 21, 22 respectively. A partition 203 is formed or defined between the notches 21. 22 of the shank 20 and includes an aperture 25 formed therein for receiving a spring 26 therein. The notches 21, 22 of the shank 20 are formed or defined between the partition 203 and a pair of actuating surfaces 202 of the shank 20 (FIGS. 4, 5).

A pair of pawls 30, 31 are received in the respective notches 21, 22 and each includes a curved cavity 301, 311 formed therein for receiving the bulges 211, 221 of the shank 20 respectively and for rotatably securing the pawls 30, 31 to the shank 20. The pawls 30, 31 each includes one or more teeth 302, 312 formed or provided on the free end portion or on the outer peripheral portion thereof for engaging with the internal gear 44 of the housing 40. The spring 26 is engaged between the pawls 30, 31 for biasing the teeth 302, 312 of the pawls 30, 31 to engage with the internal gear 44 (FIGS. 4, 5) and for controlling the driving direction of the driving stem 41 and the housing 40 by the shank 20.

The shank 20 includes an extension 204 extended rearwardly therefrom and having a size or a diameter smaller than that of the shank 20 for forming or defining a peripheral shoulder 206 between the shank 20 and the extension 204 of the shank 20. The extension 204 of the shank 20 includes a slot 207 formed therein and defined between a pair of legs 208 for rotatably receiving the seat 10. The shank 20 includes a hole 28 formed therein, such as formed in the legs 208 for receiving the shaft 73 and for rotatably securing the shank 20 and thus the driving stem 41 to the tool handle 14 via the seat 10. The shank 20, such as the extension 204 of the shank 20 includes a blind hole 23 formed therein (FIGS. 1, 2) for receiving a spring 72 and a button 80. The shank 20 further includes an aperture 27 formed therein for receiving a spring-biased projection 71 therein.

A control ferrule 50 is rotatably engaged on the shank 20 and includes a peripheral or an annular flange 501 (FIGS. 1, 3) formed therein and engaged with the peripheral shoulder 206 of the shank 20. A sleeve 60 is engaged on the shank 20 and engaged with the annular flange 501 of the control ferrule 50 for rotatably securing the control ferrule 50 on the shank 20. The sleeve 60 includes a hole 62 formed therein for receiving the shaft 73 and includes a screw hole 63 formed therein and opposite to the hole 62 for threading with the shaft 72. The sleeve 60 includes a pair of channels 64 formed therein and aligned with the slot 207 of the extension 204 for allowing the shank 20 and the sleeve 60 to be rotated relative to the seat 10. The sleeve 60 includes a hole 61 formed therein and aligned with the hole 23 of the shank 20 for slidably receiving the button 80.

The control ferrule 50 includes three depressions 51, 52, 53 and a recess 54 formed in the inner peripheral portion of the annular flange 501 for defining a block 55 between the recess 54 and the depression 51, and for defining another block 56 between the recess 54 and the other depression 53. The blocks 55, 56 are engaged with the pawls 30, 31 (FIGS. 4, 5) for disengaging the teeth 302, 312 of the pawls 30, 31 from the internal gear 44 of the housing 40 (FIG. 5) when the control ferrule 50 is rotated relative to the shank 20. The spring-biased projection 71 may engage with either of the depressions 51, 52, 53 of the control ferrule 50 for positioning the control ferrule 50 to the shank 20 at the required relative position, and for retaining the engagement or the disengaging of the pawls 30, 31 from the internal gear 44 of the housing 40.

For example, as shown in FIG. 4, when the spring-biased projection 71 is engaged with the middle depression 52 of the control ferrule 50, the blocks 55, 56 are simply contacted with the pawls 30, 31 and are not forced against the pawls 30, 31 such that the teeth 302, 312 of the pawls 30, 31 are not disengaged from the internal gear 44 and such that both pawls 30, 31 are biased to engage with the internal gear 44 simultaneously and such that the housing 40 and thus the driving stem 41 may be driven in both direction by the handle 14 via the seat 10 and the shank 20 and the pawls 30, 31.

As shown in FIG. 5, when the control ferrule 50 is rotated relative to the shank 20 to engage the spring-biased projection 71 with either of the side depressions 53 (or 51) of the control ferrule 50, the block 55 (or 56) may disengage the teeth 312 (or 302) of the pawls 31 (or 30) from the internal gear 44, and the other pawl 30 (or 31) is remain engaged with the internal gear 44, such that the housing 40 and thus the driving stem 41 may be driven in either of the directions by the handle 14 via the seat 10 and the shank 20 and the pawl 31 (or 30). The spring 26 may be stably retained in the aperture 25 of the shank 20 and may be stably engaged with the pawls 30, 31.

Figure 2:
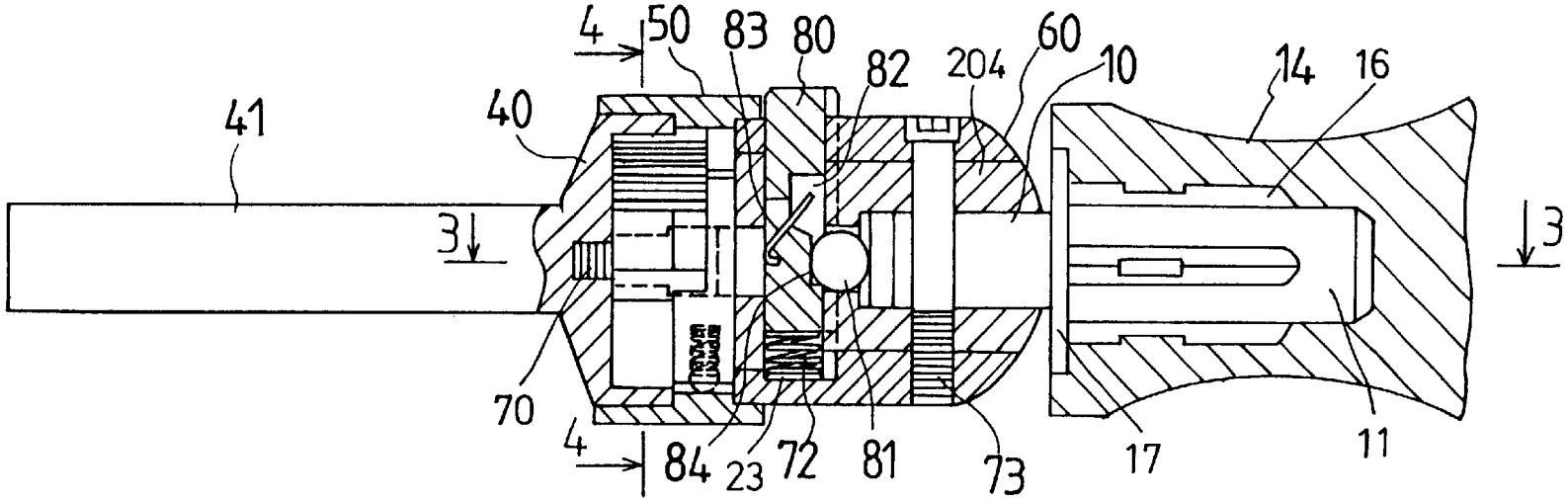
FIG. 2 is a partial cross sectional view taken along lines 2—2 of FIG. 3.
Figure 3:
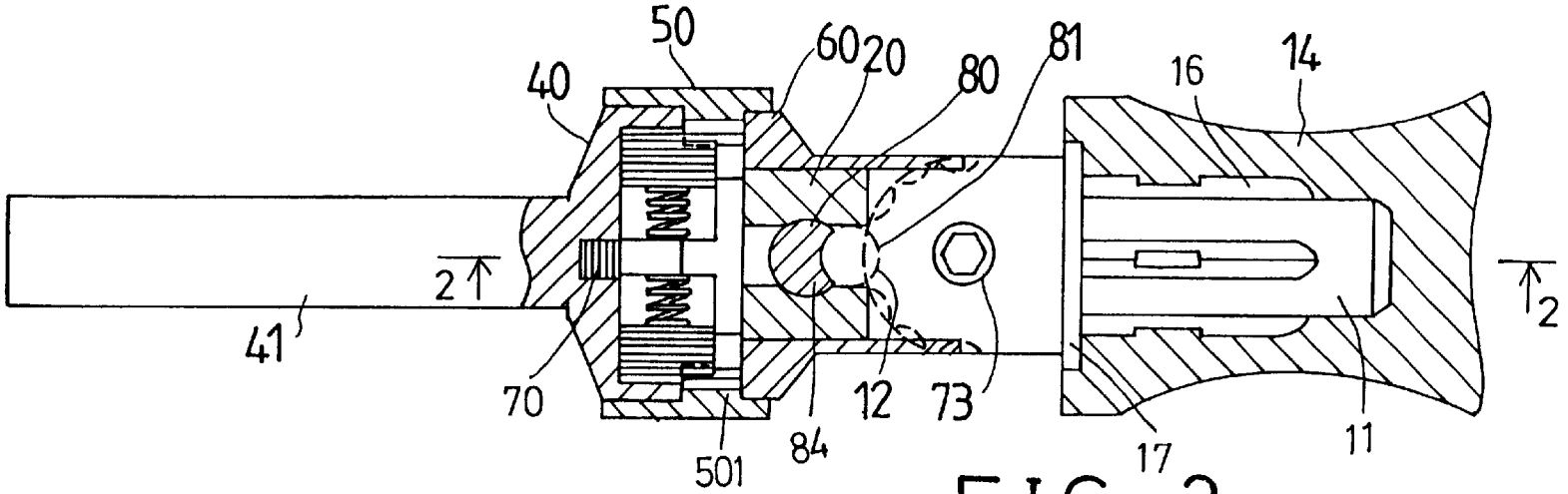
FIG. 3 is a partial cross sectional view taken along lines 3—3 of FIG. 2.

A ball 81 is received in the bore 24 of the shank 20 for engaging with either of the depressions 12 of the seat 10 and for positioning the shank 20 to the seat 10 at the required angular position (FIGS. 2, 3). The button 80 includes an opening 82 formed therein for receiving the ball 81 and for allowing the ball 81 to be disengaged from the depressions 12 of the seat 10, such that the seat 10 may be rotated relative to the shank 20. The button 80 includes an actuator 84 extended inward of the opening 82 of the button 80. The actuator 84 may be biased by the spring 72 to engage with the ball 81 and to force the ball 81 to engage with either of the depressions 12 of the seat 10 and thus to position the shank 20 to the seat 10 at the required angular position (FIGS. 2, 3).

A spring member 83 includes a leg 87 secured into a cavity 88 of the button 80 for securing to the button 80. The spring member 83 may be engaged into the opening 82 of the button 80 for biasing the ball 81 against the seat 10. When the button 80 is depressed inward of the shank 20 against the spring 72, the actuator 84 may be disengaged from the ball 81 and the ball 81 may be received in the opening 82 of the button 80, the spring member 83 may resiliently bias the ball 81 against the seat 10 for allowing the ball 81 to be moved and engaged with either of the depressions 12 of the seat 10 when the seat 10 is rotated relative to the shank 20, such that the shank 20 may be rotated and adjusted relative to the seat 10 and thus the tool handle 14 to the required angular position. The actuator 84 may be biased by the spring 72 to force the ball 81 to engage with the seat 10 again and to position the shank 20 to the seat 10 at the required angular position again when the button 80 is released.

It is to be noted that the ball 81 may be biased to engage with the seat 10 by the spring member 83 and may retain the ball 81 to the seat 10 even when the seat 10 is rotated relative to the shank 20. The provision and the engagement of the spring member 83 in the button 80 has not been disclosed in the prior arts. The pawls 30, 31 may be received in the notches 21. 22 of the shank 20 and may be rotatably secured to the shank 20 with the bulges 211, 221 and may thus be solidly engaged with the internal gear 44 of the housing 40 or of the driving stem 41, such that the driving stem 41 may be solidly driven by the shank 20 via the pawls 30, 31. The provision and the engagement of the actuating surfaces 202 of the shank 20 with the pawls 30, 31 may solidly force the pawls 30, 31 to engage with the internal gear 44, such that a great torque or force may be transmitted through or between the internal gear 44 and the pawls 30, 31 and the shank 20.

Figure 6:
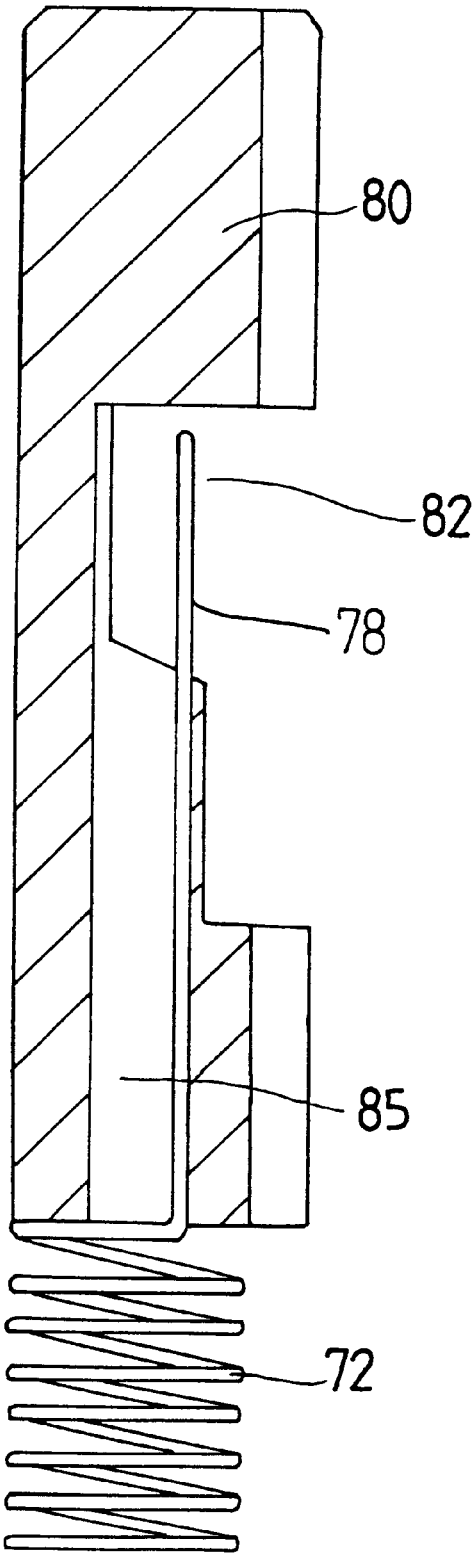
FIG. 6 is a cross sectional view illustrating another application of the control button for the ratchet tool.

Referring next to FIG. 6, the spring 72 may includes a limb 78 extended inward through a bore 85 of the button 80 and extended inward of the opening 82 of the button 80 for biasing against the ball 81 and for biasing the ball 81 against the seat 10.

Figure 7:
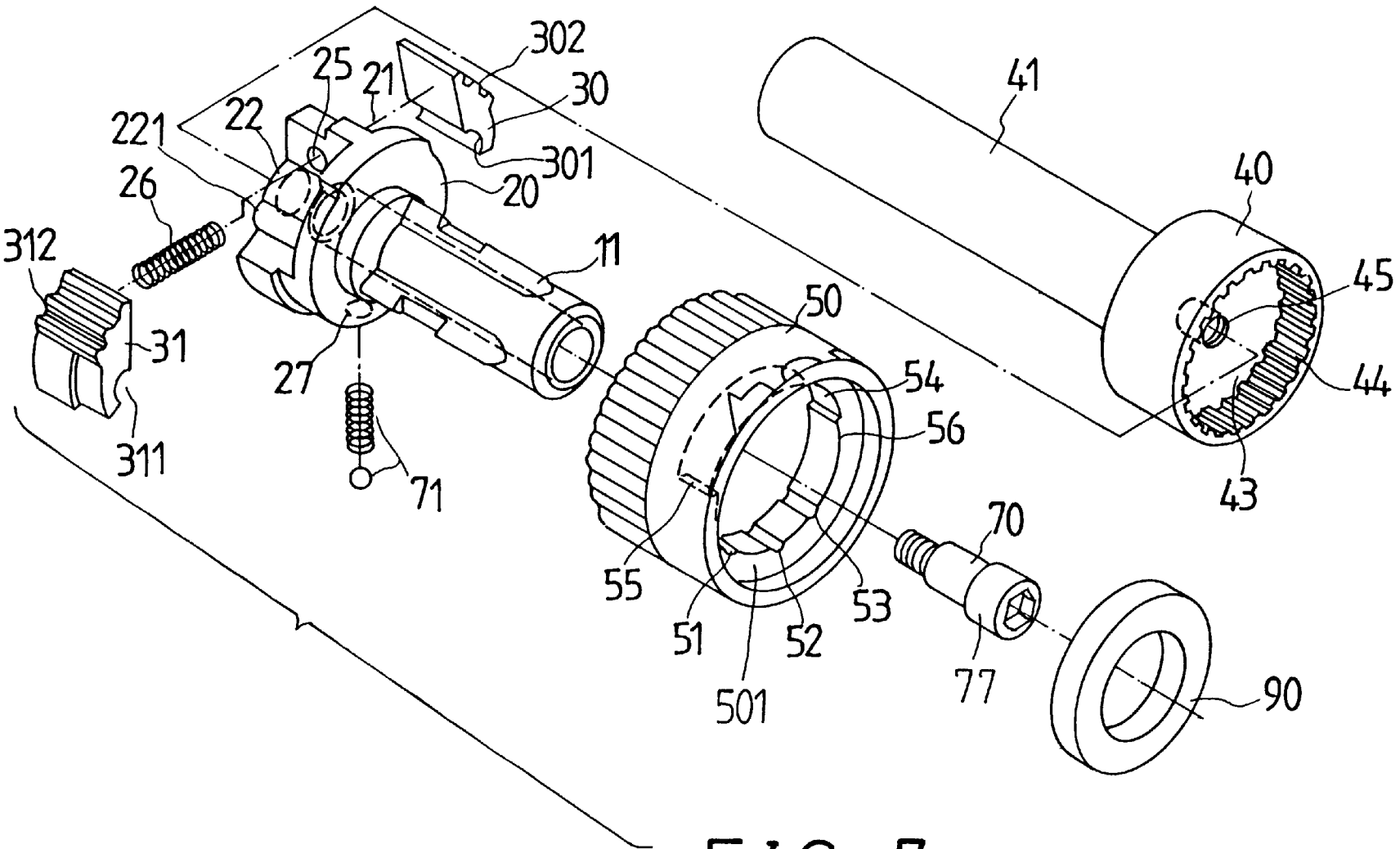
FIG. 7 is an exploded view illustrating a further application of the ratchet tool.

Referring next to FIG. 7. the shank 20 may include the stud 11 directly extended therefrom, without the extension 204 of the shank 20 and without the seat 10. A ring 90 may be engaged with the annular flange 501 of the control ferrule 50 for retaining the control ferrule 50 on the shank 20.

Figure 8:
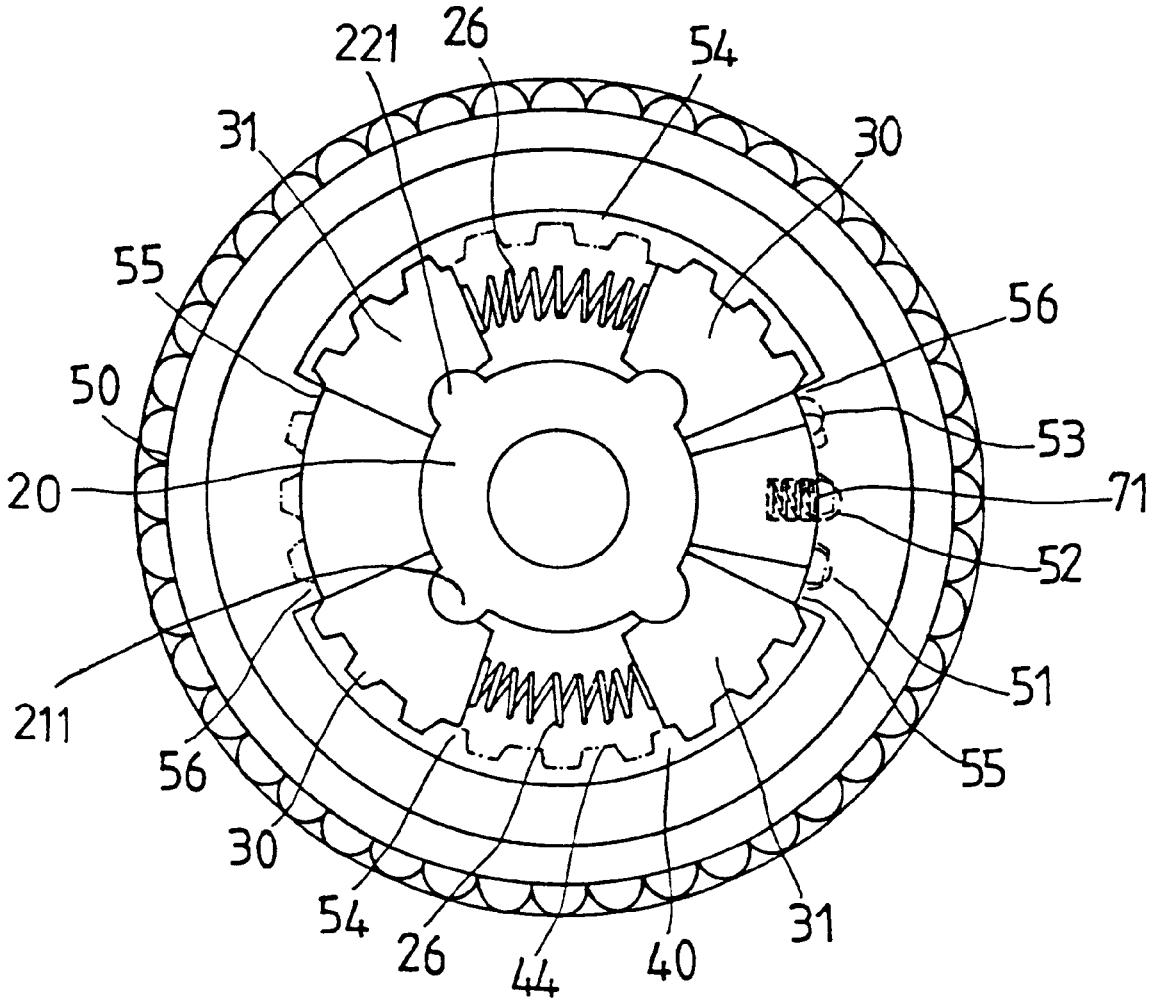
FIG. 8 is a partial cross sectional view similar to FIGS. 4 and 5, illustrating a still further application of the ratchet tool.

Referring next to FIG. 8, the ratchet device may include two pairs of pawls 30, 31 rotatably engaged with two pairs of bulges 211, 221 of the shank 20. and two springs 26 are provided and engaged with the two pairs of pawls 30, 31 for biasing the pawls 30, 31 to engage with the internal gear 44.

Figure 9:
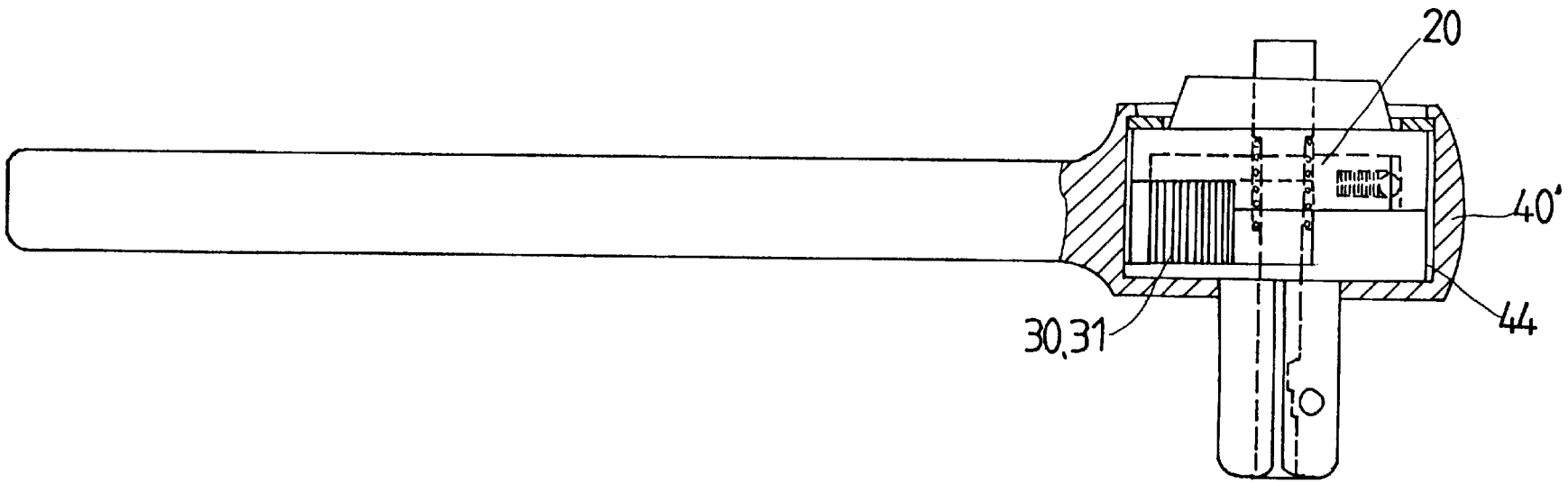
FIG. 9 is a partial cross sectional view illustrating another application of the ratchet tool.

Referring next to FIG. 9, the ratchet device including the provision or the rotational securing of the pawls 30, 31 on the shank 20 with the bulges 211, 221 of the shank 20, may also be engaged in a driving head 40' of a wrench device and may also be biased to engage with the internal gear 44 of the wrench device.

Accordingly, the ratchet tool in accordance with the present invention includes a ratchet device for resisting a great rotational driving force or a driving torque. The ratchet tool includes a driving head that may be biased and positioned to the handle with a spring biased mechanism provided in a control button.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a housing including a chamber formed therein and including an internal gear provided therein, a shank rotatably secured to said housing and received in said chamber of said housing, said shank including a pair of notches formed therein and including a part it ion formed between said notches thereof, and including a pair of actuating surfaces, said notches of said shank being defined between said partition and said actuating surfaces respectively, said shank including a pair of bulges extended inward of said notches of said shank, a first pawl and a second pawl rotatably received in said notches of said shank respectively and engageable with said actuating surfaces of said shank, for engaging with said internal gear and for controlling a driving direction of said housing relative to said shank, said first and said second pawls each including a cavity formed therein for receiving said bulges of said shank and for rotatably securing said first and said second pawl, to said shank, biasing means for biasing said first pawl and said second pawl to engage with said internal gear, and means for selectively disengaging said first pawl and said second pawl from said internal gear, said actuating surfaces of said shank being engaged with said first and said second pawls for solidly engaging said first and said second pawls with said internal gear.

2. The ratchet tool according to claim 1, wherein said housing includes a driving stem extended therefrom.

3. The ratchet tool according to claim 1, wherein said housing includes a screw hole formed therein, said shank includes a bore formed therein and includes a peripheral shoulder formed therein, a fastener is engaged in said bore of said shank and includes a head engaged with said peripheral shoulder of said shank and threaded with said screw hole of said housing for rotatably securing said shank to said housing.

4. The ratchet tool according to claim 1, wherein said partition of said shank includes an aperture formed therein, said biasing means includes a spring engaged in said aperture of said partition and engaged with said first and said second pawls.

5. The ratchet tool according to claim 1, wherein said selectively disengaging means includes a control ferrule rotatably engaged on said shank, said control ferrule includes a first block and a second block engaged with said first and said second pawls respectively for disengaging said first and said second pawls from said internal gear when said control ferrule is rotated relative to said shank.

6. The ratchet tool according to claim 5 further comprising means for positioning said control ferrule to said shank at a selected angular position.

7. The ratchet tool according to claim 5, wherein said control ferrule includes an annular flange, said shank includes a shoulder engaged with said annular flange of said control ferrule, said ratchet tool further includes a sleeve engaged on said shank and engaged with said annular flange of said control ferrule for positioning said control ferrule to said shank.

8. The ratchet tool according to claim 1 further comprising a seat including a peripheral portion having a plurality of depression formed therein, said shank including an extension extended therefrom and rotatably secured to said seat with a shaft, said shank including a bore formed therein, a ball received in said bore, and means for actuating said ball to engage with either of said depressions of said seat and to position said shank to said seat at any selected angular position.

9. The ratchet tool according to claim 8, wherein said shank includes a hole formed therein, said actuating means includes a button slidably received in said hole of said shank, said button includes an opening formed therein for receiving said ball and for allowing said ball to be disengaged from said seat, said button includes an actuator extended inward of said opening thereof for engaging with said ball and for forcing said ball to engage with either of said depressions of said seat, and a first biasing means for biasing said actuator of said button to engage with said ball and to force said ball to engage with said seat.

10. The ratchet tool according to claim 9 further comprising a second biasing means for biasing said ball to engage with said seat.

11. The ratchet tool according to claim 10, wherein said second biasing means includes a spring member secured to said button and engaged with said ball.

12. The ratchet tool according to claim 11, wherein said button includes a cavity formed therein, said spring member includes a leg engaged into said cavity of said button for securing said spring member to said button.

* * * * *